US010927494B1

(12) United States Patent
Sayarat et al.

(10) Patent No.: US 10,927,494 B1
(45) Date of Patent: Feb. 23, 2021

(54) MULTI-FUNCTIONAL BRASSIERE HOLDER

(71) Applicants: Pogan Sayarat, Dublin, OH (US); Gary Nutter, Dublin, OH (US)

(72) Inventors: Pogan Sayarat, Dublin, OH (US); Gary Nutter, Dublin, OH (US)

( * ) Notice: Subject to any disclaimer, the term of this patent is extended or adjusted under 35 U.S.C. 154(b) by 0 days.

(21) Appl. No.: 16/664,462

(22) Filed: Oct. 25, 2019

(51) Int. Cl.
*D06F 95/00* (2006.01)
*A47G 25/14* (2006.01)

(52) U.S. Cl.
CPC ..... *D06F 95/006* (2013.01); *A47G 25/14* (2013.01); *A47G 2025/1492* (2013.01)

(58) Field of Classification Search
CPC ..... A47G 25/14; A47G 2025/1492; D06F 95/006
USPC ..... 383/39, 117
See application file for complete search history.

(56) References Cited

U.S. PATENT DOCUMENTS 4,880,315 A * 11/1989 Berry ..... A45C 13/02 383/39
5,320,429 A 6/1994 Toyosawa
6,742,683 B1 6/2004 Phan
7,743,953 B2 6/2010 Okazaki et al.
7,922,046 B2 4/2011 Radtke et al.
8,181,775 B2 * 5/2012 Bunn ..... A63B 71/0036 206/315.1
8,499,930 B2 8/2013 Parness
2003/0179958 A1 * 9/2003 Chiang ..... D06F 95/006 383/38
2003/0179959 A1 * 9/2003 Nishi ..... D06F 95/006 383/38
2005/0232519 A1 * 10/2005 Grimes, Jr. ..... D06F 95/006 383/39
2010/0193383 A1 * 8/2010 Parness ..... A45C 3/004 206/288
2013/0075288 A1 * 3/2013 Bielski ..... D06F 95/006 206/278

(Continued)

FOREIGN PATENT DOCUMENTS

EP 3543392 A1 * 9/2019 ..... D06F 95/006
JP 2001252496 A 9/2001
JP 2008284086 A 11/2008

*Primary Examiner* — Jes F Pascua
(74) *Attorney, Agent, or Firm* — Standley Law Group LLP; James L. Kwak

(57) ABSTRACT

A multi-functional device for holding multiple brassieres that supports washing and drying; saves closet storage space; facilitates travel organization; prevents strap tangling; maintains cup shape; and allows visibility. The brassiere holder is constructed entirely from modern, quick-drying washable materials. This design allows the entire unit and the multiple brassieres contained inside to go from: closet; to washer; to dryer; to storage; and from storage directly into a suitcase for travel. The front of the device is covered in a high performance 4-way power stretch mesh fabric. The rear of the device is covered in a quick drying mesh fabric chosen to hold the brassieres firmly and gently in place. Each brassiere is provided a separate compartment to prevent tangling of the straps during washing. Each compartment has two specially designed cup supports made entirely of quick drying mesh pouf to maintain cup shapes and to gently press the cups into the high performance 4-way stretch power mesh to stabilize them.

26 Claims, 6 Drawing Sheets

(56) References Cited

U.S. PATENT DOCUMENTS

| | | | | |
|---|---|---|---|---|
| 2014/0109321 | A1* | 4/2014 | Allende | D06F 95/008 8/137 |
| 2017/0215616 | A1 | 8/2017 | Cunningham | |

* cited by examiner

MULTI-FUNCTIONAL BRASSIERE HOLDER

BACKGROUND OF THE INVENTIVE FIELD

This invention relates to a multi-functional brassiere holding device that facilitates washing, drying, storage, and travel organization while supporting the shape of the cup portions and preventing damage to the fabric and elastic.

Brassieres, while a necessity for proper support, are a costly investment. This is due to the variety of expensive and delicate materials used in their construction. The following problems can arise when storing and washing brassieres.

Washing: The delicate materials used in the manufacture of brassieres require special care and manufacturers recommend hand washing. However as most modern washing machines include a delicate setting, in the busy world of today it is common for brassieres to be machine washed to save time. However, when machine washed, brassieres need protection to maintain cup shape, and to prevent damage to the delicate fabrics. Brassieres also need to be kept separated to prevent entangling and stretching the straps. To facilitate effective cleaning brassiere cups should never be stacked on top of one another.

Drying: Manufacturers recommend air drying brassieres as heat from machine dryers can cause dimpling in the padding and can break down the elastic in the straps. Many brassieres are air-dried by hanging them over shower rods, on clotheslines or whatever hook is available. Brassieres hanging in shared spaces can be a nuisance for those sharing the space, and when dry, requires the additional step of taking them down and placing them in storage. To facilitate shorter air-drying times brassiere cups should never be stacked.

Storage: Most brassieres are stored in drawers or hung in closets from hangers, hooks or specially designed brassiere or combination brassiere and undergarment storage units. Drawer storage is not ideal as it lacks visibility, requiring the opening and closing of the drawers to see the contents to find the correct brassiere to go with the chosen outfit. Storage of several brassieres in one drawer, each with their two straps and hooks can result in entanglement. The process of untangling straps requires additional time, stresses the elastic straps and reduces the life of the brassiere. Finally, drawer storage does not provide support for the brassiere, which can result in deformed cups.

Travel Organization: Often, brassieres are placed in suitcases with other undergarments and items of clothing. Packing brassieres in suitcases without support can result in deformed cups.

There are prior known devices for storing brassieres. These prior devices do not teach or suggest the multi-functional brassiere holding device of the present invention.

SUMMARY OF THE GENERAL INVENTIVE CONCEPT

The object of the invention is to provide an all in one brassiere appliance that meets the challenges of washing, drying, storing, and travel organization while providing support for brassiere cups and preventing entanglement and damage to brassier straps at a reasonable price to the consumer.

This all-in-one appliance for multiple brassieres is preferably constructed entirely from modern, quick-drying washable materials. The design allows the entire unit and the multiple brassieres contained inside to go from: closet; to washer; to drying; to storage; and from storage directly into a suitcase for travel. This is accomplished by thoughtful design and fabric selections.

The front of the device is preferably covered in a high performance 4-way power stretch mesh fabric with many closely spaced holes, allowing water and air to easily infiltrate. The rear of the device is preferably covered in a quick drying mesh fabric with many closely spaced holes that are larger in size than the front mesh. This rear fabric was chosen to increase water and detergent infiltration to the side of the brassiere that is worn close to the skin. The rear mesh is preferably made from a more rigid material to hold the brassieres firmly but gently in place. Each brassiere is preferably provided a separate compartment to prevent tangling of the straps during washing. In one embodiment of the invention, each compartment has two specially designed cup supports made entirely of quick drying mesh pouf to maintain cup shapes and stabilize the brassieres in their compartments by gently pressing the cups into the high performance 4-way stretch power mesh.

In the preferred embodiment, brassieres are top loaded into their separate compartments with straps connected and each cup is slipped in place over the mesh pouf cup supports and snugly against the soft 4-way power mesh. Each brassiere compartment has strategic stitching to provide additional stability between the two cups. Once the brassieres are loaded, each compartment is secured at the top using thoughtfully placed, plastic, never rust, snaps. The entire framework of the device is preferably made of readily available fabric ribbon.

In the preferred embodiment, a fabric hanging loop is provided at the top so the device can be hung from any available hanger, hook, or other suitable structure. A smaller bottom convenience loop is provided for additional handling convenience. The dimensions are designed to allow the unit to fit any standard closet length and depth. In the preferred embodiment, there are two designs for brassiere cup sizes up through DD and greater than DD (the compartments are obviously larger to accommodate the larger cup sizes).

In one embodiment of the invention, the brassiere holding apparatus is comprised of:

a plurality of brassiere storage compartments in a stacked configuration;

wherein each of the plurality of brassiere storage compartments are comprised of:

- a front mesh fabric with a plurality of holes for allowing water and air to infiltrate into the apparatus;
- a back mesh fabric with a plurality of holes for allowing water and air to infiltrate into the apparatus;
- wherein the front and back mesh fabrics are sewn together to form a compartment for storing a brassiere;
- a left cup region for holding a left cup of the brassiere and a right cup region for holding a right cup of the brassiere;
- wherein each of the plurality of brassiere storage compartments are configured to hold the brassiere so that the left cup of the brassiere is held in place in the left cup region and the right cup of the brassiere is held in place in the right cup region during use; and wherein the apparatus is configured to allow stored brassieres to be washed, dried, and stored without taking the stored brassieres out of the apparatus.

The apparatus is also comprised of an outer frame portion made of fabric ribbon; and wherein the outer frame portion is sewn together to frame the outside edges of the apparatus. A middle fabric ribbon is preferably sewn onto the front mesh fabric to provide additional rigidity to the apparatus and for splitting the front mesh fabric of each brassiere compartment down the middle. A plurality of fasteners are placed on the middle fabric ribbon for separating the left and right cup regions of each of the plurality of brassiere storage compartments from each other.

The apparatus is substantially see-through so that a user can identify items stored in the apparatus. In the preferred embodiment, a plastic snap fastener is placed at a top edge of each of the plurality of brassiere storage compartments for fastening the front and back mesh fabrics together to prevent the brassiere from falling out of the apparatus.

In one embodiment, a plurality of mesh pouf cup supports are positioned in each of the left and right cup regions for maintaining the brassier cup shape during use. The mesh pouf cup supports are removably attached to the apparatus and are preferably made from quick drying mesh fabric. The mesh pouf cup supports are positioned and sized to press the brassiere cups against the front mesh fabric during storage and use.

In one embodiment, the plurality of holes in the back mesh fabric are bigger than the plurality of holes in the front mesh fabric. The front mesh fabric may be a 4-way stretch fabric and the back mesh fabric may be a substantially non-stretchable fabric.

In one embodiment, the apparatus is further comprised of two stabilizers placed at the top of the apparatus for engaging the ends of a clothes hanger for providing stabilization to the apparatus when in the hanging position. A series of fasteners may be placed along a top edge of each of the plurality of brassiere storage compartments for fastening the front and back mesh fabrics together to prevent the brassiere from falling out of the apparatus. Support stitching may also be placed along the middle fabric ribbon for providing additional stability for holding the left and right cups of the brassiere in place.

The foregoing and other features and advantages of the present invention will be apparent from the following more detailed description of the particular embodiments, as illustrated in the accompanying drawings.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
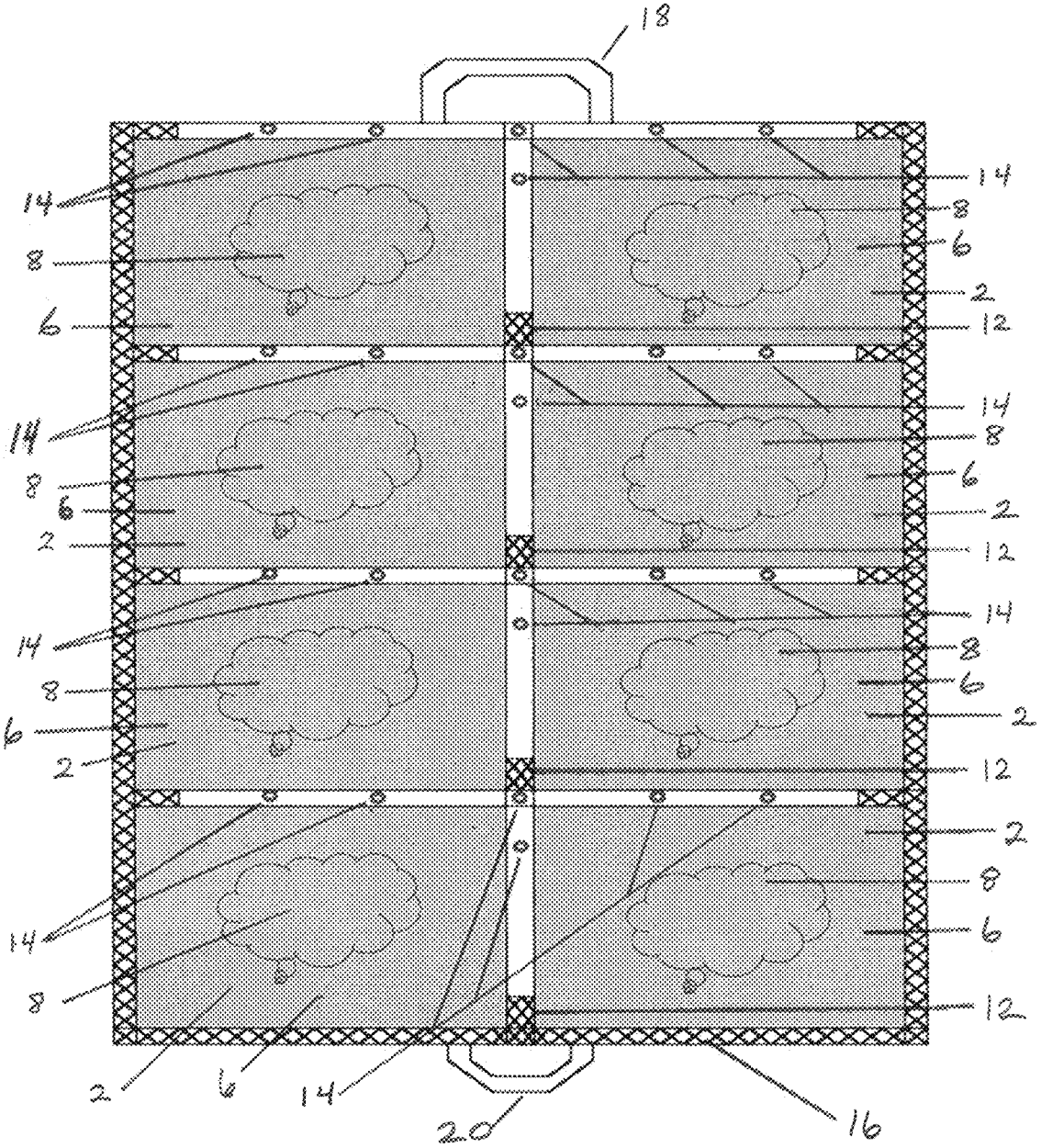
FIG. 1 is a front view of one embodiment of the invention for brassiere cup sizes through DD.

The following detailed description of the exemplary embodiments refers to the accompanying figures that form a part thereof. The detailed description provides explanations by way of exemplary embodiments. It is to be understood that other embodiments may be used having mechanical and electrical changes that incorporate the scope of the present invention without departing from the spirit of the invention.

In the description which follows like parts are marked throughout the specification and drawings with the same reference numerals, respectively. The drawing figures may not necessarily be to scale.

Figure 2:
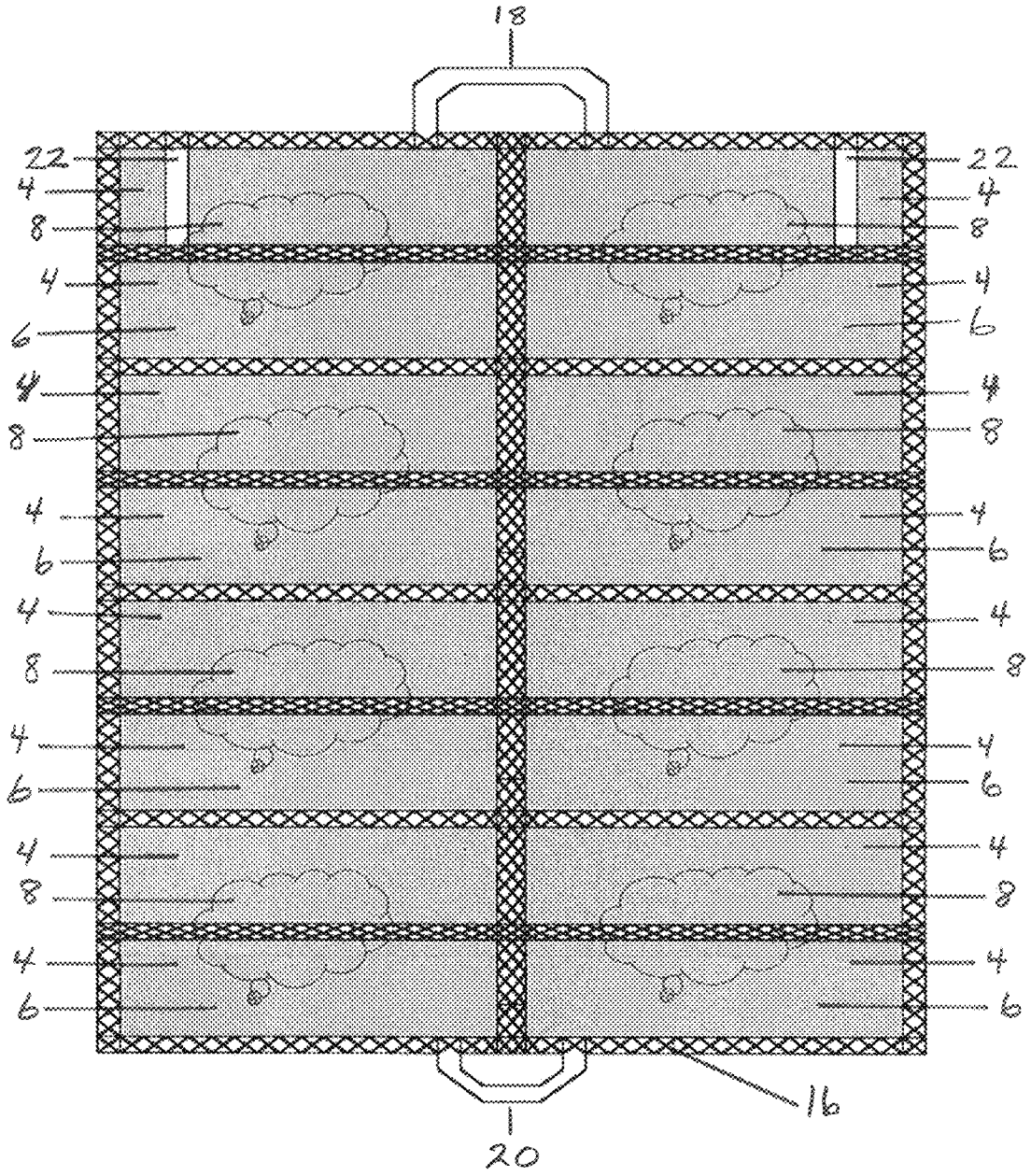
FIG. 2 is a back view of the device of FIG. 1 for brassiere cup sizes through DD.

FIG. 1 is a front view of one embodiment of the invention for brassiere cup sizes through (or up to) DD. FIG. 2 is a back view of the device of FIG. 1 for brassiere cup sizes through DD.

Figure 3:
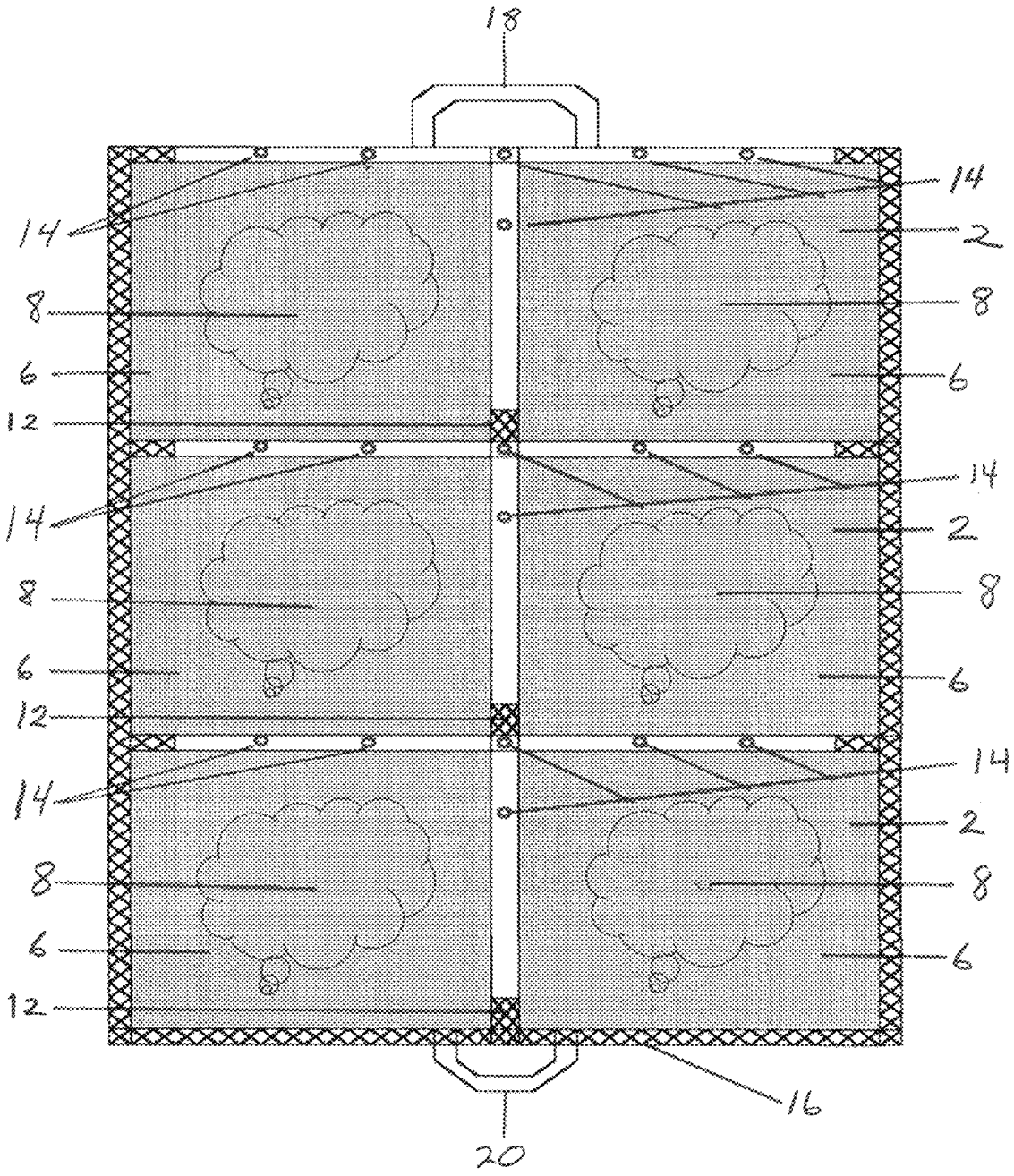
FIG. 3 is a front view of one embodiment of the invention for brassiere cup sizes greater than DD.
Figure 4:
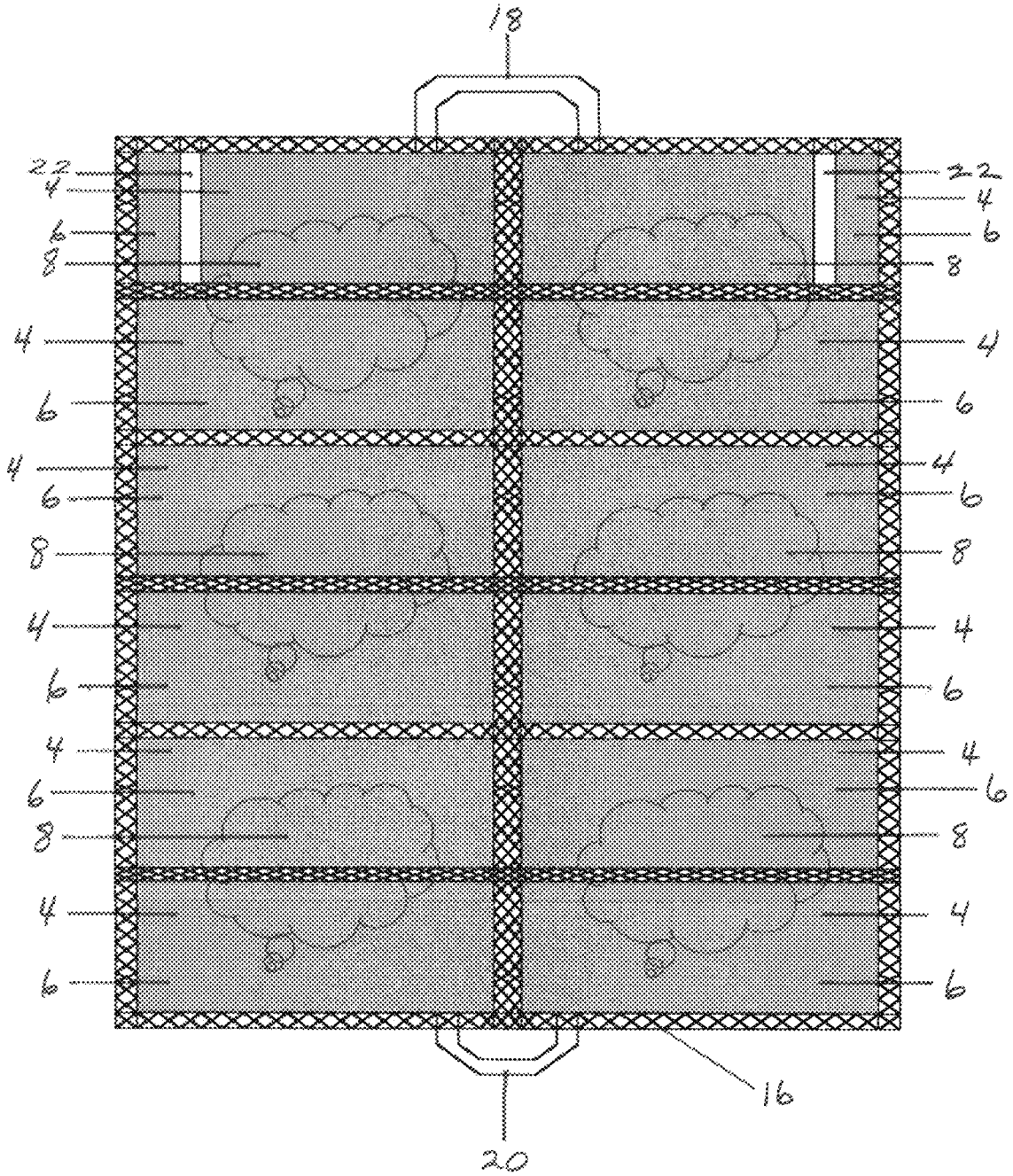
FIG. 4 is a back view of the device of FIG. 3 for brassiere cup sizes greater than DD.

FIG. 3 is a front view of one embodiment of the invention for brassiere cup sizes greater than DD. FIG. 4 is a back view of the device of FIG. 3 for brassiere cup sizes greater than DD. The brassiere holder of the present invention as shown in FIGS. 3 and 4 have the basic design as the brassiere holder of FIGS. 1 and 2 except that the storage compartments of the brassiere holder of FIGS. 3 and 4 are larger to accommodate the larger bra size. For example, in one embodiment, both of the brassiere holders shown in FIGS. 1-4 have a width of 18" and height of 29". However, the brassiere holder of FIGS. 3 and 4 only have three stacked brassiere storage compartments to the four stacked brassiere storage compartments of FIGS. 1 and 2.

The front of the device as shown in FIG. 1 and FIG. 3 is preferably comprised of a high performance 4-way power stretch mesh fabric 2 with many closely spaced holes, allowing water and air to easily infiltrate the compartments. The rear of the device as shown in FIG. 2 and FIG. 4 is preferably covered in a quick drying mesh fabric 4 with many closely spaced wholes that are larger in size than the front mesh. The rear mesh fabric 4 was chosen to increase water and detergent infiltration to the side of the brassiere that is worn close to the skin. The rear mesh fabric 4 preferably does not stretch, but is stable, to hold the brassieres firmly and gently in place. The front mesh fabric 2 and the rear mesh fabric 4 form each of the brassiere compartments of the present invention. The bottom edge of each of the separate compartments are sewn shut to form storage compartments (or pockets) as shown in the figures. The top edge of each of the separate compartments are left open so that the user may load each compartment with a brassiere.

Figure 5:
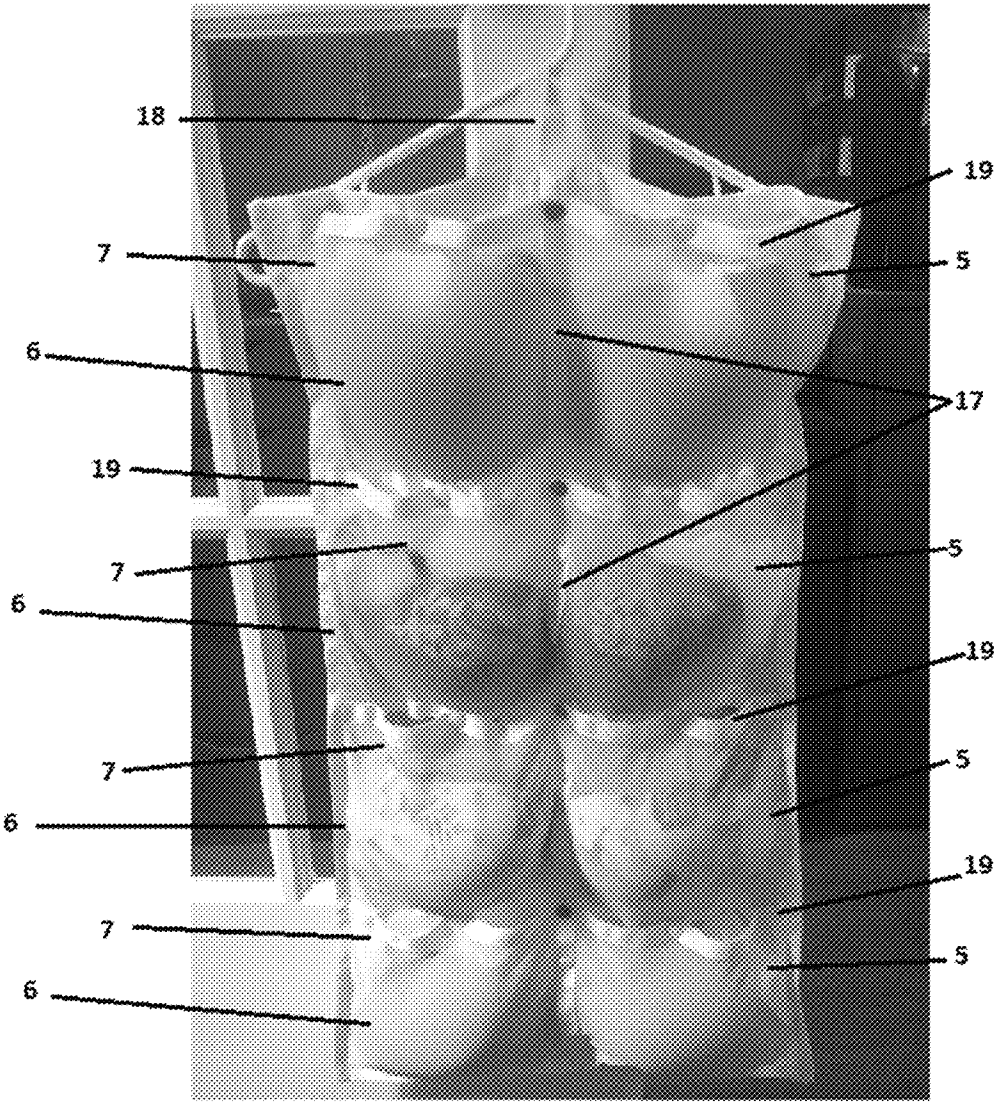
FIG. 5 is a front view of one embodiment of the invention in use showing stacked brassiers.
Figure 6:
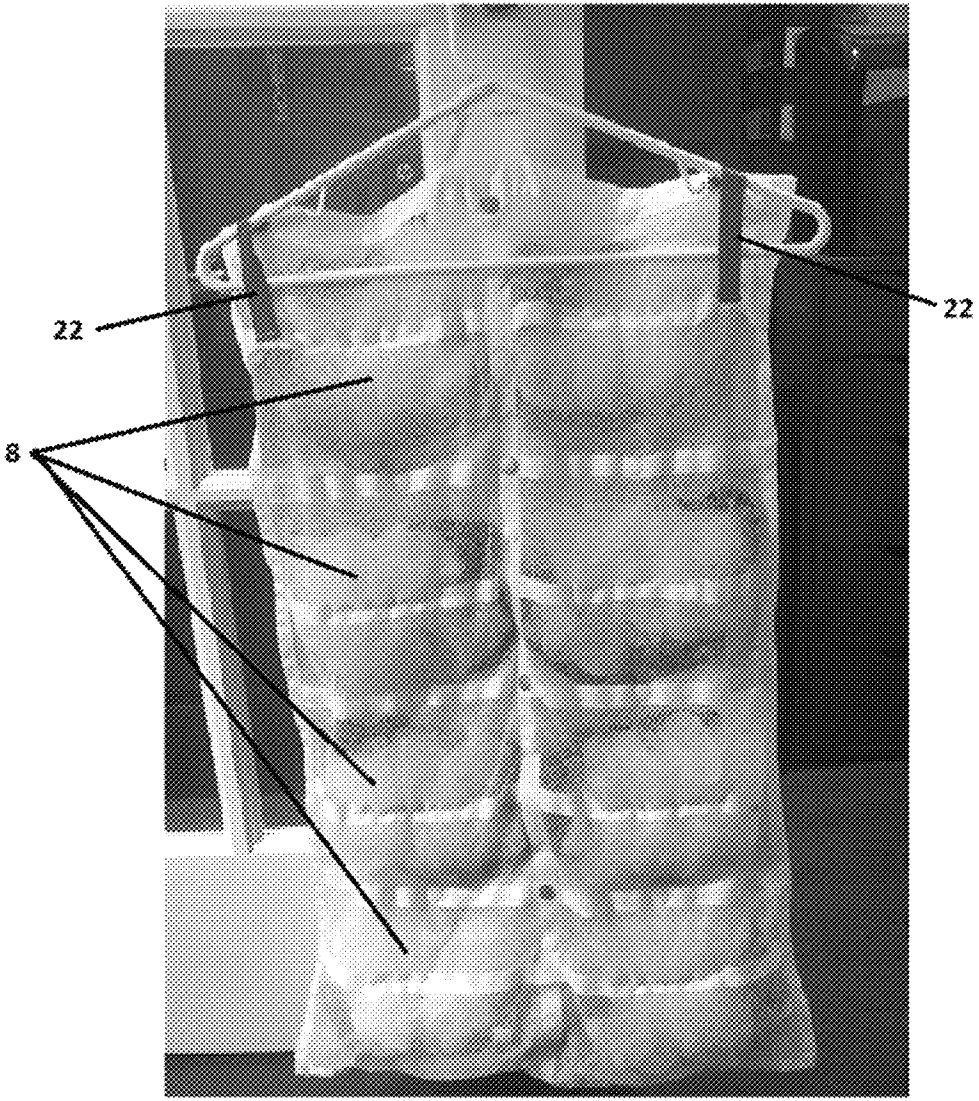
FIG. 6 is a back view of the device of FIG. 5.

Each brassiere is preferably provided a separate compartment 6 to prevent tangling of the straps during washing. As discussed, in the preferred embodiment, there are a plurality of separate brassiere storage compartments 6 in stacked configuration (e.g., configured on top of each other) where each separate compartment is adapted to hold at least one brassiere. Each separate compartment is comprised of a left cup region 5 for holding a left cup of a brassiere and a right cup region 7 for holding a right cup of the same brassiere. In this fashion, a plurality of brassieres are stored in a stacked configuration by the present invention (see e.g., FIGS. 5 and 6). FIG. 5 is a front view of one embodiment of the invention in use showing stacked brassieres held in each of the stacked storage compartments. FIG. 6 is a back view of the device of FIG. 5.

Each compartment preferably has two specially designed cup supports 8 (one for the left cup of a brassiere and another for the right cup of the brassiere). In the preferred embodiment, each cup support is comprised of a pouf (e.g., fluffy part of an accessory) made entirely of quick drying mesh pouf and appropriately sized to maintain cup shapes and stabilize the brassieres in their compartments 6 by gently pressing the cups into the high performance 4-way stretch power mesh 2. Brassieres are preferably loaded through the top of their separate compartments 6 with straps connected and where each cup is slipped in place over the mesh pouf cup supports 8 and snugly against the high performance 4-way stretch power mesh 2. In one embodiment, each brassiere compartment 6 has strategic stitching 12 to provide additional stability between the two cups. Once the brassieres are loaded, each compartment is secured at the top using thoughtfully placed, plastic, never rust, snaps 14.

In the preferred embodiment, the entire framework of the device is made of readily available fabric ribbon 16. Fabric ribbon is also preferably used along a middle portion 17 of each device (splitting the front mesh cover of each brassiere compartment down the middle). In the embodiment shown in the figures, a plurality of fasteners are placed on the middle fabric ribbon for separating the left and right cup regions of each of the plurality of brassiere storage compartments from each other. These fasteners can be opened to allow the user to put in or remove a brassiere from the brassiere storage compartments or they can be closed to prevent the stored brassieres from moving around (and bending out of shape) during storage or use.

Thus, in the preferred embodiment, because the apparatus of the present invention is made substantially of mesh fabric and fabric ribbon sewn together, the apparatus is adapted to be rolled up or folded for more efficient storage or transportation. This design also allows the apparatus of the present invention to be placed completely in the washer without damaging the appliances or the brassieres.

Fabric ribbon is also preferably used along a top edge portion 19 of each brassiere compartment. The snap fasteners of the present invention can be sewn into the fabric ribbon portions 17, 19 as shown in the figures.

A fabric hanging loop is provided at the top 18 so the device can be hung from any available hanger, hook, or other suitable structure. Two elastic stabilizers 22 are provided at the top ends of the device to provide extra support when using common closet hangers to hang the device. A smaller bottom convenience loop is provided for additional handling convenience 20.

While certain embodiments of the present invention are described in detail above, the scope of the invention is not to be considered limited by such disclosure, and modifications are possible without departing from the spirit of the invention as evidenced by the following claims:

What is claimed is:

1. A brassiere holding apparatus, comprised of:

a plurality of brassiere storage compartments in a stacked configuration;

wherein each of the plurality of brassiere storage compartments are comprised of:

a front mesh fabric with a plurality of holes for allowing water and air to infiltrate into the apparatus;

a back mesh fabric with a plurality of holes for allowing water and air to infiltrate into the apparatus;

wherein the front and back mesh fabrics are sewn together to form a compartment for storing a brassiere;

a left cup region for holding a left cup of the brassiere and a right cup region for holding a right cup of the brassiere;

a plurality of mesh pouf cup supports positioned in each of the left and right cup regions for maintaining the brassier cup shape during use, and wherein the mesh pouf cup supports are formed by an arrangement of quick drying mesh fabric arranged into a fluffy pouf shape that is non-convex;

wherein each of the plurality of brassiere storage compartments are configured to hold the brassiere so that the left cup of the brassiere is held in the left cup region and the right cup of the brassiere is held in the right cup region during use; and wherein the apparatus is configured to allow stored brassieres to be washed, dried, and stored without taking the stored brassieres out of the apparatus.

2. The apparatus according to claim 1, further comprising:

an outer frame portion made of fabric ribbon; and wherein the outer from portion is sewn together to form the outside edges of the apparatus.

3. The apparatus according to claim 1, further comprising:

a middle fabric ribbon sewn onto the front mesh fabric to provide additional rigidity to the apparatus and for splitting the front mesh fabric of each brassiere compartment down the middle.

4. The apparatus according to claim 3, further comprising:

a plurality of fasteners placed on the middle fabric ribbon for separating the left and right cup regions of each of the plurality of brassiere storage compartments from each other, and wherein the plurality of fasteners placed on the middle fabric can be opened from a closed position to allow easier removal of the brassiere from the holding apparatus.

5. The apparatus according to claim 3, further comprising support stitching placed along the middle fabric ribbon for providing additional stability for holding the left and right cups of the brassiere in place.

6. The apparatus according to claim 1, wherein the apparatus is substantially see-through so that a user can identify items stored in the apparatus.

7. The apparatus according to claim 1, further comprising:

a fastener at a top edge of each of the plurality of brassiere storage compartments for fastening the front and back mesh fabrics together to prevent the brassiere from falling out of the apparatus.

8. The apparatus according to claim 7, wherein the fastener is a plastic snap fastener.

9. The apparatus according to claim 1, wherein the mesh pouf cup supports are removably attached to the apparatus.

10. The apparatus according to claim 1, wherein the mesh pouf cup supports are positioned and sized to press the brassiere cups against the front mesh fabric during storage and use.

11. The apparatus according to claim 1, wherein the plurality of holes in the back mesh fabric are bigger than the plurality of holes in the front mesh fabric.

12. The apparatus according to claim 1, wherein the front mesh fabric is a 4-way stretch fabric.

13. The apparatus according to claim 12, wherein the back mesh fabric is a substantially non-stretchable fabric.

14. The apparatus according to claim 1, further comprising two stabilizers placed at the top of the apparatus for engaging the ends of a clothes hanger for providing stabilization to the apparatus when in the hanging position.

15. The apparatus according to claim 1, further comprising a top hanging loop for accepting a clothes hanger.

16. The apparatus according to claim 1, further comprising:

a series of fasteners placed along a top edge of each of the plurality of brassiere storage compartments for fastening the front and back mesh fabrics together to prevent the brassiere from falling out of the apparatus.

17. A brassiere holding apparatus, comprised of:

a plurality of brassiere storage compartments in a stacked configuration;

wherein each of the plurality of brassiere storage compartments are comprised of:

a front mesh fabric with a plurality of holes for allowing water and air to infiltrate into the apparatus;

a back mesh fabric with a plurality of holes for allowing water and air to infiltrate into the apparatus;

wherein the front and back mesh fabrics are sewn together to form a compartment for storing a brassiere;

a left cup region for holding a left cup of the brassiere and a right cup region for holding a right cup of the brassiere;

wherein each of the plurality of brassiere storage compartments are configured to hold the brassiere so that the left cup of the brassiere is held in the left cup region and the right cup of the brassiere is held in the right cup region during use;

a plurality of mesh pouf cup supports positioned in each of the left and right cup regions for maintaining the brassier cup shape during use, and wherein the mesh pouf cup supports are formed by an arrangement of quick drying mesh fabric arranged into a fluffy pouf shape that is non-convex; and wherein the apparatus is configured to allow stored brassieres to be washed, dried, and stored without taking the stored brassieres out of the apparatus.

18. The apparatus according to claim 17, further comprising:

an outer frame portion made of fabric ribbon; and wherein the outer frame portion is sewn together to form the outside edges of the apparatus.

19. The apparatus according to claim 17, further comprising:

a middle fabric ribbon sewn onto the front mesh fabric to provide additional rigidity to the apparatus and for splitting the front mesh fabric of each brassiere compartment down the middle.

20. The apparatus according to claim 19, further comprising:

a plurality of fasteners placed on the middle fabric ribbon for separating the left and right cup regions of each of the plurality of brassiere storage compartments from each other; wherein the plurality of fasteners placed on the middle fabric can be opened from a closed position to allow easier removal of the brassiere from the holding apparatus.

21. The apparatus according to claim 17, wherein the apparatus is substantially see-through so that a user can identify items stored in the apparatus; and wherein the apparatus is adapted to be rolled up or folded.

22. The apparatus according to claim 17, further comprising:

a fastener at a top edge of each of the plurality of brassiere storage compartments for fastening the front and back mesh fabrics together to prevent the brassiere from falling out of the apparatus.

23. The apparatus according to claim 17, wherein the mesh pouf cup supports are removably attached to the apparatus.

24. The apparatus according to claim 17, wherein the mesh pouf cup supports are positioned and sized to press the brassiere cups against the front mesh fabric during storage and use.

25. A brassiere holding apparatus, comprised of:

a plurality of brassiere storage compartments in a stacked configuration;

wherein each of the plurality of brassiere storage compartments are comprised of:

a front mesh fabric with a plurality of holes for allowing water and air to infiltrate into the apparatus;

a back mesh fabric with a plurality of holes for allowing water and air to infiltrate into the apparatus;

wherein the front and back mesh fabrics are sewn together to form a compartment for storing a brassiere;

a left cup region for holding a left cup of the brassiere and a right cup region for holding a right cup of the brassiere;

wherein each of the plurality of brassiere storage compartments are configured to hold the brassiere so that the left cup of the brassiere is held in place in the left cup region and the right cup of the brassiere is held in place in the right cup region during use;

a plurality of mesh pouf cup supports positioned in each of the left and right cup regions for maintaining the brassier cup shape during use, and wherein the mesh pouf cup supports are formed by an arrangement of quick drying mesh fabric arranged into a fluffy pouf shape that is non-convex;

a middle fabric ribbon sewn onto the front mesh fabric to provide additional rigidity to the apparatus and for splitting the front mesh fabric of each brassiere compartment down the middle; and wherein the apparatus is adapted to be rolled up or folded;

wherein the apparatus is configured to allow stored brassieres to be washed, dried, and stored without taking the stored brassieres out of the apparatus.

26. The apparatus according to claim 25, further comprising:

a plurality of fasteners placed on the middle fabric ribbon for separating the left and right cup regions of each of the plurality of brassiere storage compartments from each other; wherein the plurality of fasteners placed on the middle fabric can be opened from a closed position to allow easier removal of the brassiere from the holding apparatus.

* * * * *